United States Patent [19]

Kupka et al.

[11] 4,336,032

[45] Jun. 22, 1982

[54] PROCESS FOR STABILIZING MIXTURES OF GASOLINE AND METHANOL

[75] Inventors: Genevieve L. Kupka, Paris; Mehdi Zar-Ayan, La Frette Sur Seine, both of France

[73] Assignee: PCUK Produits Chimiques Ugine Kuhlmann, Courbevoie, France

[21] Appl. No.: 135,791

[22] Filed: Mar. 31, 1980

[30] Foreign Application Priority Data

Apr. 6, 1979 [FR] France ..... 79 08750

[51] Int. Cl.[3] ..... C10L 1/18

[52] U.S. Cl. ..... 44/56

[58] Field of Search ..... 44/56, 77

[56] References Cited

U.S. PATENT DOCUMENTS 1,752,724 4/1930 Bourie ..... 44/56
3,211,539 10/1965 Phillips ..... 44/77
4,154,580 5/1979 Landis ..... 44/56

FOREIGN PATENT DOCUMENTS 1770627 6/1968 Fed. Rep. of Germany .
2114465 6/1972 France .
7330645 6/1970 Japan .

*Primary Examiner*—Winston A. Douglas
*Assistant Examiner*—Y. Harris-Smith
*Attorney, Agent, or Firm*—Beveridge, DeGrandi and Kline

[57] ABSTRACT

A process for stabilizing mixtures of gasoline and methanol containing at least 30% by volume of methanol is disclosed wherein a primary, linear or branched chain monohydroxylated aliphatic saturated alcohol containing from 8 to 15 carbon atoms or a mixture of such alcohols, is added to the gasoline/methanol mixture. The stabilized mixtures described herein are useful as a fuel for automobiles.

5 Claims, No Drawings

PROCESS FOR STABILIZING MIXTURES OF GASOLINE AND METHANOL

The present invention relates to a process for stabilizing mixtures of gasoline and methanol and the stabilized mixtures thus obtained. What is understood by a stabilizing process within the scope of the present invention is a process which permits the mixtures of gasoline and methanol to be rendered homogeneous at low temperature, in the presence of small quantities of water.

It is known to use mixtures of gasoline and methanol as motor fuel. The use of such mixtures presents advantages for the fight against atmospheric pollution (considerable reduction in the CO content of exhaust gases; possibility of using gasolines which contain less tetraethyllead or are even exempt from tetraethyllead, hence a reduction in the lead content in exhaust gases).

However, in order to be able to be used as a fuel, the mixtures of gasoline and methanol must be homogeneous. However, in the presence of small quantities of water, such mixtures are not homogeneous at low temperature and separate into two phases. To obtain homogeneous mixtures of gasoline and methanol at low temperature, it would therefore be advantageous to avoid the incorporation of water, but in practice it is difficult to avoid contamination by small quantities of water, in particular during the storage of gasoline/methanol mixtures.

It has already been proposed (cf. Japanese Patent Application 41-38899/66 published on Aug. 26, 1970 with number 45.25779/70) to stabilize gasoline/methanol mixtures at low temperature in the presence of small quantities of water; i.e. to avoid the above-mentioned separation into phases, by adding simultaneously to these mixtures an aromatic hydrocarbon having a boiling point in the region of 80°-180° C. (in practice benzene, toluene or xylenes) and an alcohol having at least 3 carbon atoms chosen from cyclohexanol, propanol, butanol, amyl alcohol and hexyl alcohol. The added quantities of aromatic hydrocarbon and alcohol vary with the nature of the gasoline, the percentage of methanol in the gasoline/methanol mixture, the percentage of water present and the temperature of non-miscibility which it is desirable to obtain (what is understood by the temperature of non-miscibility is the temperature below which there is separation into two phases). The stabilized mixtures obtained in the Japanese Patent Application contain 10 to 30 parts by volume of methanol, 0.2 to 3 parts by volume of alcohol having at least 3 carbon atoms, 5 to 30 parts by volume of added aromatic hydrocarbon, and at most 0.35 part by volume of water, the mixture being supplemented to 100 parts by gasoline.

According to the present invention, a new process has now been found to stabilize gasoline/methanol mixtures. This process permits mixtures of gasoline and methanol to be stabilized which contain at least 30% by volume of methanol, and in particular those mixtures containing 30% to 60% by volume of methanol and 70% to 40% by volume of gasoline, in the presence of quantities of water at most equal to 0.5% by volume in relation to the volume of the gasoline/methanol mixture. More specifically, the process according to the invention permits a temperature of non-miscibility lower than or equal to 0° C., preferably lower than or equal to −5° C., to be obtained for the above-mentioned gasoline/methanol mixtures, in the presence of the above-mentioned quantities of water.

The process according to the invention comprises adding to the gasoline/methanol mixtures a primary, linear or branched chain, monohydroxylated aliphatic saturated alcohol containing from 8 to 15 carbon atoms or a mixture of such alcohols. Examples of suitable primary monohydroxylated aliphatic saturated alcohols are, in particular, 1-octanol, 1-nonanol, 2-ethyl-1-hexanol, the branched-chain alcohols corresponding to the general formula $C_7H_{15}CH_2OH$, and branched-chain alcohols corresponding to the general formula $C_8H_{17}CH_2OH$. Examples of suitable mixtures of alcohols are, in particular, the mixtures of isomeric branched-chain alcohols of the formula $C_7H_{15}CH_2OH$ (mixtures known under the common name of isooctanol), mixtures of isomeric branched-chain alcohols of the formula $C_8H_{17}CH_2OH$ (mixtures known under the common name of isononanol), mixtures of primary monohydroxylated aliphatic saturated alcohols having 9 to 11 carbon atoms, in particular mixtures of primary monohydroxylated aliphatic saturated alcohols having 9 or 11 carbon atoms in which the linear chain alcohols are predominant (such mixtures are known under the commercial name of Acropol 91), and mixtures of primary monohydroxylated aliphatic saturated alcohols having 13 to 15 carbon atoms, in particular the mixtures of primary monohydroxylated aliphatic saturated alcohols having 13 to 15 carbon atoms in which the linear chain alcohols are predominant (such mixtures are known under the commercial name of Acropol 35). The mixtures of primary monohydroxylated aliphatic saturated alcohols having 9 to 11 carbon atoms in which the linear chain alcohols are predominant, known under the commercial name of Acropol 91, are preferably employed as the additive.

The quantity of additive (alcohol or mixture of alcohols such as defined above) to be added to the gasoline/methanol mixtures to stabilize them: i.e. to obtain a non-miscibility temperature lower than or equal to 0° C., preferably lower than or equal to −5° C., in the presence of quantities of water not exceeding 0.5%, is dependent upon the exact nature of the additive, the nature of the gasoline, the composition by volumes of the gasoline/methanol mixture and the percentage of water. The quantity of additive to be added to the mixture does not generally exceed 10% by volume in relation to the volume of the gasoline/methanol mixture.

The mixtures of gasoline and methanol which may be stabilized by the process according to the invention are not only those in which the gasoline is an ordinary gasoline, with or without tetraethyllead or tetramethyllead, as defined in the French standard NF M 15-001, but also those in which the gasoline is a high-octane gasoline, with or without tetraethyllead or tetramethyllead.

The stabilized mixtures obtained by the process according to the invention are novel compositions and, as such, form part of the invention. Those stabilized mixtures contain gasoline, methanol, an additive (alcohol or mixture of alcohols) as defined above and possibly water, the ratio of volume methanol/gasoline being greater than or equal to 30:70 and the percentage of water being lower than or equal to 0.5% by volume in relation to the volume of the gasoline/methanol mixture. The stabilized mixtures according to the invention contain, in particular, 30 to 60 parts by volume of methanol, 70 to 40 parts by volume of gasoline, 0 to 0.5 part by volume of water and at most 10 parts by volume of additive. The stabilized mixtures according to the invention are usable as fuel for automobiles.

The following examples, in which the parts mentioned are parts by volume, are illustrative of the invention and are not intended to limit it in any respect.

EXAMPLE 1

At ambient temperature (20° C. to 25° C.), mixtures of gasoline, methanol, water and additive are obtained, whose composition is specified in Table I hereinafter. The additive used is either isooctanol, or the mixture of primary monohydroxylated aliphatic saturated alcohols having 9 or 11 carbon atoms, in which the linear chain alcohols are predominant, known under the commercial name Acropol 91. The gasoline used is an ordinary gasoline corresponding to the specifications of French standard NF M 15,001, which standard is relied on in this respect and incorporated by reference.

If the mixture is homogeneous at ambient temperature, it is progressively cooled until there is separation into two phases, and the temperature is noted at which the two phases appear. If the mixture is heterogeneous (two phases) at ambient temperature, it is heated progressively and the temperature is noted at which it becomes homogeneous. In the two cases, the temperature thus noted corresponds to the temperature of non-miscibility.

The results obtained are given in Table I.

TABLE 1

| Mixture | Gasoline Parts by volume | Methanol Parts by volume | Water Parts by volume | Additive Parts by volume | Temperature of non-miscibility |
|---|---|---|---|---|---|
| 1 | 50 | 50 | 0 | 0 | +9° C. |
| 2 | 50 | 50 | 0.5 | 0 | +26° C. |
| 3 | 50 | 50 | 0.5 | 2.5 (iso-octanol) | +17° C. |
| 4 | 50 | 50 | 0.5 | 2.5 (Acropol 91) | +10° C. |
| 5 | 50 | 50 | 0.5 | 5 (iso-octanol) | 0° C. |
| 6 | 50 | 50 | 0.5 | 5 (Acropol 91) | −5° C. |

EXAMPLE 2

The process is carried out as in Example 1 on mixtures containing 40, 50 or 70 parts of gasoline for 60, 40 or 30 parts of methanol, respectively. The gasoline used is the same as the one in Example 1. The additive used is Acropol 91. The results obtained are given in Table II.

Further modifications of the invention will be apparent to those skilled in the art from the foregoing and are intended to be emcompassed by the claims appended hereto.

TABLE II

| Mixture | Gasoline Parts by volume | Methanol Parts by volume | Water Parts by volume | Additive Parts by volume | Temperature of non-miscibility |
|---|---|---|---|---|---|
| 7 | 40 | 60 | 0 | 0 | 0° C. |
| 8 | 40 | 60 | 0.5 | 0 | +20° C. |
| 9 | 40 | 60 | 0.5 | 2.5 | −3° C. |
| 10 | 40 | 60 | 0.5 | 5 | −18° C. |
| 11 | 60 | 40 | 0 | 0 | +13° C. |
| 12 | 60 | 40 | 0.5 | 2.5 | +13° C. |
| 13 | 60 | 40 | 0.5 | 5 | 0° C. |
| 14 | 70 | 30 | 0 | 0 | +10° C. |
| 15 | 70 | 30 | 0.5 | 2.5 | +16° C. |
| 16 | 70 | 30 | 0.5 | 5 | 0° C. |

What is claimed is:

1. A process for stabilizing mixtures of gasoline and methanol containing 30% to 60% by volume of methanol and 70% to 40% by volume of gasoline which comprises adding to these mixtures a primary, branched or linear chain, monohydroxylated aliphatic saturated alcohol containing 8 to 15 carbon atoms, or a mixture of such alcohols, the quantity of said alcohol or mixture of alcohols added to the mixture of gasoline and methanol being less than or equal to 10% by volume in relation to the volume of the gasoline/methanol mixture.

2. The process according to claim 1, wherein the alcohol or mixture of alcohols added is selected from the groups consisting of 1-octanol, 1-nonanol, 2-ethyl-1-hexanol, branched-chain alcohols of the formula $C_7H_{15}CH_2OH$ and their mixtures, branched-chain alcohols of the formula $C_8H_{17}CH_2OH$ and their mixtures, mixtures of primary monohydroxylated aliphatic saturated alcohols having 9 to 11 carbon atoms, and mixtures of primary monohydroxylated aliphatic saturated alcohols having 13 to 15 carbon atoms.

3. The process according to claim 1 wherein a mixture of alcohols is added which is a mixture of primary monohydroxylated aliphatic saturated alcohols having 9 or 11 carbon atoms, in which mixture the linear chain alcohols are predominant.

4. A composition comprising 30 to 60 parts by volume of methanol, 70 to 40 parts by volume of gasoline, 0 to 0.5 part by volume of water and at most 10 parts by volume of a primary, linear or branched chain, monohydroxylated aliphatic saturated alcohol, containing from 8 to 15 carbon atoms or a mixture of such alcohols.

5. The composition according to claim 4, in which the mixture of alcohols is a mixture of primary monohydroxylated aliphatic saturated alcohols containing 9 or 11 carbon atoms, in which mixture the linear chain alcohols are predominant.

* * * * *